US006192802B1

(12) United States Patent
Baginski

(10) Patent No.: US 6,192,802 B1
(45) **Date of Patent: *Feb. 27, 2001**

(54) RADIO FREQUENCY AND ELECTROSTATIC DISCHARGE INSENSITIVE ELECTRO-EXPLOSIVE DEVICES

(75) Inventor: Thomas A. Baginski, Auburn, AL (US)

(73) Assignee: Auburn University, Auburn, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/060,669

(22) Filed: Apr. 15, 1998

Related U.S. Application Data

(63) Continuation-in-part of application No. 08/518,169, filed on Aug. 24, 1995, now Pat. No. 5,847,304.

(51) Int. Cl.[7] ..... F42B 3/18

(52) U.S. Cl. ..... 102/202.2; 102/202.7; 102/202.9

(58) Field of Search ..... 102/202.1, 202.2, 102/202.3, 202.4, 202.5, 202.7, 202.9, 202.11

(56) References Cited

U.S. PATENT DOCUMENTS

| | | | |
|---|---|---|---|
| 3,831,523 | 8/1974 | Thomas et al. | 102/28 |
| 3,882,324 | 5/1975 | Smolker et al. | 307/202 |
| 3,974,424 | 8/1976 | Lee | 317/80 |
| 4,061,088 | 12/1977 | Ueda | 102/28 |
| 4,271,453 | 6/1981 | Yajima et al. | 361/248 |
| 4,304,184 | 12/1981 | Jones | 102/202 |
| 4,378,738 | 4/1983 | Proctor et al. | 102/202 |
| 4,422,381 | 12/1983 | Barrett | 102/202 |
| 4,428,292 | 1/1984 | Riggs | 102/202 |
| 4,517,895 | 5/1985 | Rucker | 102/202 |
| 4,586,435 | 5/1986 | Bock | 102/202 |
| 4,592,280 | 6/1986 | Shores | 102/202 |
| 4,690,056 | 9/1987 | Brede et al. | 102/202 |
| 4,708,060 | 11/1987 | Bickes, Jr. et al. | 102/202 |
| 4,729,315 | 3/1988 | Proffit et al. | 102/202 |
| 4,779,532 | 10/1988 | Riley et al. | 102/202 |
| 4,819,560 | 4/1989 | Patz et al. | 102/202 |
| 4,840,122 | 6/1989 | Nerheim | 102/202 |
| 4,893,563 | 1/1990 | Baginski | 102/202 |
| 4,944,224 | 7/1990 | Fiedler et al. | 102/202 |
| 4,967,665 | 11/1990 | Baginski | 102/202 |
| 4,976,200 | 12/1990 | Benson et al. | 102/202 |
| 5,085,146 | 2/1992 | Baginski | 102/202 |
| 5,088,412 * | 2/1992 | Patrichi | 102/202.5 |
| 5,088,413 | 2/1992 | Huber et al. | 102/202 |
| 5,099,762 | 3/1992 | Drapala | 102/202 |
| 5,179,248 | 1/1993 | Hartmman et al. | 102/202 |
| 5,309,841 | 5/1994 | Hartman et al. | 102/202 |
| 5,448,114 | 9/1995 | Kondoh et al. | 257/778 |
| 5,454,320 | 10/1995 | Hilden et al. | 102/202 |
| 5,672,841 * | 9/1997 | Monk et al. | 102/202.4 |
| 5,798,475 * | 8/1998 | Reynes et al. | 102/202.5 |
| 5,847,309 * | 12/1998 | Baginski | 102/202.5 |
| 5,905,226 * | 5/1999 | Baginski | 102/202.7 |

FOREIGN PATENT DOCUMENTS 581316 8/1959 (CA) .

* cited by examiner

*Primary Examiner*—Harold J. Tudor
(74) *Attorney, Agent, or Firm*—Womble, Carlyle, Sandridge & Rice, PLLC

(57) ABSTRACT

An electro-explosive device ("EED") having resistors fabricated on a thermally conductive substrate and interconnected by a central bridge element. The resistance of the bridge element is lower than that of the resistors, which have a larger surface area to volume ratio. The conductive bridge of the EED is overcoated with a composite overcoat comprising a metal and an oxidizer, which produce a chemical explosion upon plasma vaporization of the conductive bridge.

20 Claims, 6 Drawing Sheets

RADIO FREQUENCY AND ELECTROSTATIC DISCHARGE INSENSITIVE ELECTRO-EXPLOSIVE DEVICES

REFERENCE TO RELATED APPLICATION

This invention is a continuation-in-part of U.S. patent application Ser. No. 08/518,169 filed Aug. 24, 1995 now U.S. Pat. No. 5,847,304.

FIELD OF INVENTION

This invention generally relates to an electro-explosive device and, more particularly, to a radio frequency and electrostatic discharge insensitive electro-explosive device having improved firing efficiency.

BACKGROUND OF THE INVENTION

In general, an electro-explosive device (EED) receives electrical energy and initiates a mechanical shock wave and/or an exothermic reaction, such as combustion, deflagration, or detonation. The EED has been used in both commercial and government applications for a variety of purposes, such as to initiate airbags in automobiles or to activate an energy source in an ordnance system. With reference to FIG. 1, a typical EED 10 comprises a thin resistive wire or bridgewire 12 suspended between two posts 14, only one of which is shown. The bridgewire 12 is surrounded by a flammable or explosive compound 18, commonly referred to as a pyrotechnic mix. To initiate combustion of the pyrotechnic mix 18, a DC or very low frequency current is supplied through lead wires 16 and posts 14 and then though the bridgewire 12. The current passing through the bridgewire 12 results in ohmic heating of the bridgewire 12 and, when the bridgewire 12 reaches the ignition temperature of the pyrotechnic mix 18, the pyrotechnic mix 18 initiates. The pyrotechnic mix 18 is a primary charge which ignites a secondary charge 20, which in turn ignites a main charge 22. The EED 10 further comprises various protective elements, such as a sleeve 23, a plug 24, and a case 26.

Although the EED 10 is a well known device, the electromagnetic go environment in which EED's operate has changed dramatically over the past four decades. One change that has occurred in the operating environment for the EED's is that the EED's are being subjected to higher levels of electromagnetic interference (EMI). The necessary operation of high power radar and communication equipment in the proximity of EED's, such as in an aircraft carrier flight deck, has resulted in a typical operating environment that includes high intensity electromagnetic fields. The EED which initiates an airbag in an automobile may be subjected to severe EMI during the normal life-span of the automobile. Thus, EED's are being subjected to high levels of EMI in both military and non-military environments.

The high intensity radio-frequency (RF) fields present a serious EMI problem by coupling electromagnetic energy either through a direct or indirect path to an EED, so as to cause accidental firing. Electromagnetic energy may be coupled directly to the EED when RF radiation is incident on the EED's chassis whereby the EED acts as the load of a receiving antenna. The electromagnetic energy may alternatively be coupled indirectly to the EED when RF induced arcing occurs in the vicinity of the EED and is coupled to the EED, such as through its leads. An RF induced discharge can occur whenever a charge accumulated across an air gap is sufficient to ionize the gas and sustain an ionized channel.

The EED's which are located in the vicinity of intense RF fields, such as naval surface ships, may receive signal components due to rectification of RF radiation. The RF radiation can be rectified, for instance, due to simple metal contact diode action, which is generally caused by corrosion of contacts or incorrectly connected fasteners. The rectified signal may have components that are at much lower frequencies than the source RF radiation and may also contain a DC component, any of which may couple to the EED and cause accidental ignition. The RF radiation may be rectified in many environments in which an EED may be found, including an automotive environment where large currents or voltages are switched very quickly thereby producing high levels of noise.

Another manner in which an EED may be accidentally discharged is by the coupling of an electrostatic discharge (ESD) to the EED. An ESD is characterized as a signal which is of a high voltage and fairly low energy. While the energy of the ESD is usually insufficient to cause any significant ohmic heating of the EED, the high voltage can create a sufficiently large electric field between the input pins of the EED to ignite the pyrotechnic mix.

One approach to protect an EED from EMI is to install one or more passive filters. Several standard types of passive filters exist which can be utilized to attenuate stray RF signals. These filters can usually be classified as either L, Pi, or T types, or as combinations of the three types. The L, Pi, and T type passive filters, which are respectively illustrated in FIGS. 2(A), (B), and (C), have traditionally been used as a first measure of eliminating EMI problems.

Conventional passive filters being used with EED's, however, have several disadvantages. A conventional filter consists of a combination of inductors, capacitors and/or other lossy elements, such as resistive ferrites. In general, the performance of the filter is directly proportional to the number and size of the elements used in its construction. Thus, a filter can be designed to attenuate a signal to a larger extent if the size of the inductors, capacitors and ferrite sleeves are all increased. Also, a filter having a greater number of stages will generally have an improved performance. The size of the filter, however, is often limited by the amount of available space. As a result, it may not be possible to add a filter to an EED or the filter which can fit within the available space may be ineffective in protecting the EED from EMI.

The filters are usually constructed from standard passive components assembled on a printed circuit board or hard-wired within a metal chassis. A typical example of an RF filter 30 is shown in FIG. 3(A). The RF filter 30 comprises, inter alia, a ceramic capacitor 32 and a wound torroidal inductor 34. As shown in FIG. 3(B), the ceramic capacitor 32 has a plurality of electrode layers 38 separated by a ceramic dielectric material 36. As should be apparent from FIG. 3(A), the size of the capacitor 32 and inductor 34 render the filter 30 too large for many applications, such as with weapon systems where space is especially limited. Therefore, a need exists for a small sized EED which is adequately protected from EMI.

In addition to the constraint of available space, the cost of the EED and filter can also limit the size of the filter. The cost of each filter is directly related to the number of capacitors, inductors, and other elements forming the filter. Even though some filters may have only a few components, the cost per unit price in assembling the filter may be relatively high in comparison to the cost of an EED. Thus, with a large scale production of EED's and their associated filters, the overall increase in cost can become quite substantial.

A further disadvantage to passive filters is that they are unable to filter out many low frequency signals which can cause accidental firing of the EED. Because the signal for firing an EED is a DC signal, the conventional filters are designed to freely transmit DC and other low frequency signals. These filters, therefore, are unable to attenuate the low frequency signals due to rectification of RF signals as well as other low frequency or DC signals.

Even with a filter that can effectively filter many types of EMI, the EED is not completely safe from accidental firing. In a conventional filter system, the filter and EED are essentially two separate components. With reference to FIG. 4, a non-propagating magnetic field B may induce an emf via closed loop induction. The emf is proportional to wAB, where B=moH, A is the cross-sectional area, and w is the frequency of the magnetic field B.

The EED can be further protected from EMI by shielding. The shielding of an EED, however, is effective only if construction of a barrier and operational procedures can guarantee the integrity of the shielding structure. When a large number of EED's are manufactured, it becomes likely that some of the EED's will have defective shielding structure. Thus, shielding of the EED is not the best approach in protecting the EED.

Another device designed to protect an EED from accidental firing is a spark gap arrester. The spark gap arrester is used to reduce the chance that an electrostatic discharge (ESD) will produce an accidental firing and is essentially comprised of two conductive electrodes separated a precise distance, thereby defining an air gap. When the strength of an electric field developed across the conductors exceeds the dielectric strength of the air, a breakdown occurs and excess electric charge is free to flow across the air gap from one conductor to the other conductor. The conductor which receives the excess charge is typically connected to ground so that the charge is directed away from any sensitive elements in the EED.

A spark gap arrester relies upon precise spacing of electrodes to assure that a static discharge is shunted to the ground. The mechanics of constructing the precise air gaps can involve expensive manufacturing techniques. As a result, a spark gap arrester can significantly increase the cost of an EED.

The spark gap arrester may also be destroyed during installation and handling of the EED. A typical spark gap arrester is a discharge disc or sheet having a central opening through which lead wires can extend. A thin electrically conductive layer is in contact with the casing of the EED but is out of contact with the lead wires by the precise air gap. If the lead wires are bent, such as during assembly, the effectiveness of the spark gap may be severely hampered.

In order to reduce the sensitivity of an EED to stray signals, the total energy of the firing signal which is necessary to ignite the EED may be increased. As a result, low level stray signals can be conducted through the bridgewire without causing any ignition and only the higher level firing signal would have sufficient energy to ignite the EED.

A higher magnitude firing signal, however, is not always desirable. An EED typically has an initiation system which supplies the EED with the firing signal. The initiation system typically has a capacitor which stores the charge necessary for generating the firing signal. If the energy of the firing signal is increased and voltage remains constant, the size of the capacitor must also increase. Because of the larger capacitor, the cost of the initiation system substantially increases. Thus, by decreasing the magnitude of the firing signal, the cost of the EED and initiation system can be reduced.

It is also desirable to have a lower firing signal when the amount of available power or energy is limited. For instance, many automobiles are presently being manufactured with dual air bags, each of which requires a separate EED. Future designs of automobiles may have two or more airbags and may additionally employ EED's to actuate seat belts in the event of a collision. With the larger number of EED's that will likely be in an automobile, the magnitude of the firing signal should be as small as possible.

In the automobile environment, an airbag must be activated as quickly as possible in the event of a collision in order to maximize the amount of protection provided to the occupant of the vehicle. The EED which activates the airbag must therefore be able to ignite quickly, yet cannot be accidentally ignited with stray RF or with an ESD. Further, as described above, the EED should additionally be activated with a low energy firing signal. It has been difficult in the industry to produce an EED which can be activated quickly, which is insensitive to RF and to an ESD and is inexpensive to manufacture, and which is ignited with a low energy firing signal.

The use of an EED in an automotive environment presents other difficulties as well. For instance, the EED commonly used today to activate automotive airbags typically uses lead-azide or lead-styphinate as a primary charge. Lead-azide is an extremely explosive material and produces a fast travelling shock wave when ignited. Due to the highly explosive nature of lead-azide and the magnitude of the shock wave produced upon explosion, a steel mesh must necessarily be placed around the EED to prevent the shock output of the EED from rupturing the airbag. The high strength steel mesh, however, complicates the manufacturing process and adds further cost to the EED structure. A need therefore exists for a lower cost EED which does not require the use of a primary explosive.

The sensitivity of an EED also may be lowered with the use of a ferrite bead. When a hollowed ferrite bead is placed over a wire, the ferrite bead will pass the DC firing signal but will present an impedance that increases with frequency. Thus, with EMI, the ferrite bead will present an impedance to these signals which will thereby convert the electromagnetic energy from the signals into heat.

The effectiveness of a ferrite bead is rather limited. As the intensity of the stray signal increases, the temperature of the ferrite bead rises and, at a certain temperature, the ferrite bead loses its magnetic characteristics. Once the ferrite bead becomes too hot, the EMI is no longer converted by the ferrite bead into heat but is instead coupled to the EED, possibly igniting the EED. Thus, at higher signal levels, the ferrite bead is unable to divert the EMI away from the EED.

SUMMARY OF THE INVENTION

It is a general object of the invention to overcome the above-mentioned disadvantages of the prior art.

It is an object of the present invention to provide an electro-explosive device which is insensitive to electromagnetic interference.

It is another object of the present invention to provide an electro-explosive device which is insensitive to electrostatic discharge.

It is a further object of the present invention to provide an electro-explosive device which is insensitive to stray RF fields.

It is yet another object of the present invention to provide a small-sized electro-explosive device.

It is yet a further object of the present invention to provide a relatively low cost electro-explosive device.

It is a still further object of the present invention to provide an electro-explosive device which can be ignited with a low energy signal.

Another object of the invention is to provide an EED with substantially improved firing efficiency to permit the pyrotechnic mixture to be loaded in the device using less expensive methods.

A still further object of the invention is to provide an improved EED with integrally formed diode shunts for rejecting ESD events.

Another object of the invention is to provide an EED that produces a substantially higher energy plasma/chemical explosion for coupling more energy to an adjacent pyrotechnic mix.

To achieve the foregoing and other objects, in accordance with the present invention, in a preferred embodiment thereof, an electro-explosive device (EED) is fabricated on a substrate and comprises first and second elements fabricated on the substrate both of which have a first resistance. A third element interconnects the two elements, has a second resistance which is much less than the first resistance, and is for evaporating in a plasma to ignite a pyrotechnic compound. The series connection of the three elements presents an overall resistance which has non-linear characteristics. At low signal intensities, the third element receives significantly less energy from an applied signal than the other two elements. At higher signal intensities, however, the resistance of the third element is much more than the other two elements whereby the third element receives most of the energy from the applied signal.

In one embodiment, the first, second, and third elements are comprised of a layer of aluminum with the first and second elements being formed in a serpentine-shape and having a surface area to volume ratio which is much higher than that for the third element. As a result, a stray RF signal as well as an ESD have most of their energy converted into heat by the serpentine elements and only a small amount dissipated by the third element. The substrate is preferably thermally conductive so that any heat generated by the first or third element is directed away from the first or third element. To aid and improve the ignition process, a layer of zirconium is deposited onto the third element and heats up along with the third element. The zirconium layer explodes/vaporizes in a plasma along with the third element and both of these materials condense on the pyrotechnic compound, which comprises a mixture of zirconium and potassium perchlorate. An EED according to the invention can operate quicker and more efficiently since the vaporized zirconium can react directly with the potassium perchlorate in the pyrotechnic compound. In another embodiment, the third element is formed from a bowtie-shaped layer of zirconium and the first two elements comprise metal-oxide resistances formed between an oxide phase formed on the zirconium layer and a metal in an overlying electrical contact. The electrical contacts are formed on either end of the zirconium layer and have a large surface area. The metal-oxide resistances are much larger than that of the zirconium layer but decrease with the intensity of the applied signal. Thus, with a higher intensity firing signal, the zirconium layer will receive more of the energy from the firing signal until the zirconium layer is converted to a plasma.

Another aspect of the invention relates to a shunting element for use with an electro-explosive device. The shunting element comprises a substrate and a conductive layer formed on the substrate. The conductive layer has a bowtie shape with a narrow central portion. First and second contacts are formed on either end of the bowtie-shaped conductive layer. The conductive layer presents a low impedance path between the first and second contacts. The central portion of the conductive layer acts as a fuse and vaporizes in a plasma at a signal intensity above a certain threshold level. Preferably, the conductive layer comprises aluminum and the substrate is thermally conductive so that ohmic heat may be directed away from the aluminum layer.

In yet another embodiment of the present invention, an EED having integral diode shunts and improved firing efficiency is formed on a silicon chip using traditional integrated circuit etching and deposition technology. An insulating layer of silicon dioxide is first formed on the surface of the silicon chip and a pair of spaced apart areas are etched away to expose the underlying surface of the silicon chip. Spaced areas or layers of aluminum are then deposited over the etched away areas and this forms a pair of Schottky barrier diodes spaced from each other on the silicon chip. A generally bow-tie shaped layer of palladium is then deposited on the surface of the chip. The bow-tie shaped palladium layer is shaped to define first and second lands that are spaced apart from each other on the chip and a relatively narrow conductive bridge that extends between and electrically connects the lands. Each of the lands covers and is bonded and electrically coupled to a respective one of the Schottky diodes and the area of each of the lands is much larger than the area of the bridge that extends between the lands. With this configuration, the diodes are electrically coupled in parallel with the bridge to form a diode shunt.

A contact pad is formed on the surface of each of the lands for connecting the lands with solder, conductive epoxy, or other appropriate means to a source of current for firing the EED. Preferably, each of the contact pads is formed on its respective land by sequentially depositing on the land a layer of titanium, which bonds to the palladium of the land, a layer of nickel, which provides good electrical contact to the titanium layer, and a layer of gold, which provides a corrosion resistant exposed surface for connection of lead wires to the lands.

The conductive bridge that extends between and electrically couples the lands together is overcoated with a composite overcoat, which, in the preferred embodiment, comprises a layer of a fuel such as zirconium that is covered with a layer of appropriate oxidizer such as, for example, iron oxide, copper oxide. The zirconium and oxidizer form a chemically explosive composite overcoat on the bridge. The EED is then mounted in a casing wherein lead wires electrically connect the lands to posts that project from the casing for connection to a source of firing current. The casing is then loaded with an appropriate pyrotechnic compound such as a combination of powdered zirconium and potassium perchlorate, which is loaded in the casing atop the EED.

In use, the EED of this embodiment is protected from accidental firing due to ESD and EMI events both by the diode shunt that is formed integrally with the EED on the silicon chip and by the dissipation of ohmically generated heat away from the bridge by the relatively much larger lands on either side of the bridge. When it is desired to fire the EED, the appropriate firing potential, which preferably is slightly less than the break down or turn-on voltage of the diodes, is supplied to the lands for an appropriate length of time. This causes current to flow through the conductive bridge, which heats the bridge rapidly until it vaporizes in a high temperature plasma. This high temperature plasma explosion, in turn, causes the zirconium and oxidizer coatings on the bridge to be heated rapidly to an ignition temperature, whereupon an explosive chemical reaction is initiated between the zirconium and the oxidizer.

The result is a high energy chemical/plasma explosion, which creates a fireball that propogates away from the surface of the EED a distance much greater than a plasma explosion alone and with significantly greater energy. This energy is coupled to the adjacent pyrotechnic compound, causing it to be ignited, which, in turn, initiates an explosive device such as, for example, an automotive air bag initiator.

A prime advantage of the just described embodiment stems from the high energy plasma/chemical explosion generated by the zirconium/oxidizer overcoatings on the bridge of the EED. Since this explosion is of higher energy and propagates much further from the EED than a simple plasma explosion, it is significantly more efficient at coupling energy to and igniting the adjacent pyrotechnic compound. As a consequence, the pyrotechnic compound need not be packed tightly against the surface of the EED using relatively expensive high pressure loading processes and less expensive loading techniques can be used. In addition, thermally and/or mechanically induced migration of the pyrotechnic compound away from the surface of the EED does not significantly affect the firing efficiency of the device. In fact, with this embodiment, it has been found that less expensive plastic casings can be used in place of metal casings and the pyrotechnic compound can be loaded into the casing using less expensive processes such as slurry loading, all without affecting the firing efficiency of the device.

Thus, a unique new EED is now provided that is ESD and EMI insensitive, efficient and effective in operation, economical to produce, and particularly suited for use in automotive air bag initiators and similar devices where predictable and reliable triggering and long periods of stable dormancy are required. These and other objects, features and advantages will become more apparent upon review of the detailed description set forth below taken in conjunction with the accompanying drawings, which are briefly described as follows.

BRIEF DESCRIPTION OF THE DRAWINGS

The accompanying drawings, which are incorporated in, and form a part of, the specification, illustrate preferred embodiments of the present invention and, together with the description, serve to illustrate and explain the principles of the invention. The drawings are not necessarily to scale, emphasis instead being placed on clearly illustrating the principles of the invention. In the drawings.

DETAILED DESCRIPTION OF THE PREFERRED EMBODIMENTS

Figure 5A:
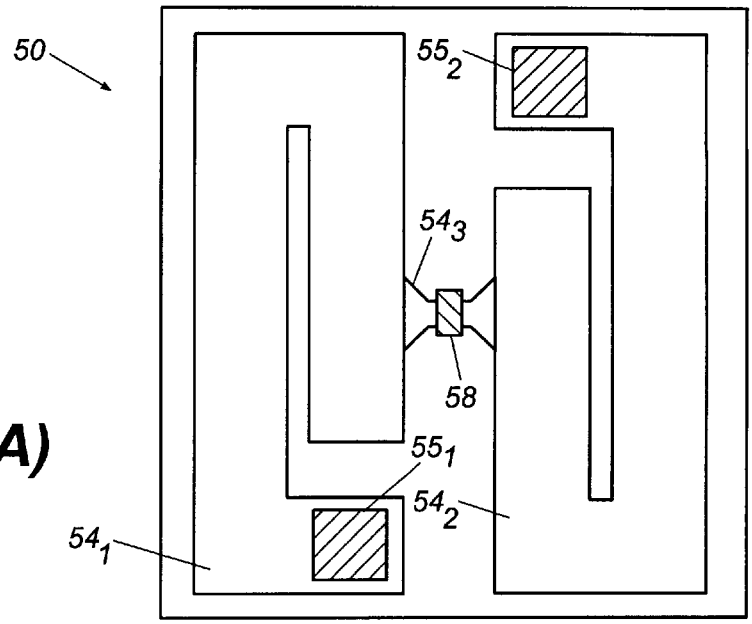
FIG. 5(A) is a top view of an electro-explosive device according to a first embodiment of the invention.

Reference will now be made in detail to the preferred embodiments of the invention, which are illustrated in the accompanying drawings. With reference to FIGS. 5(A) and (B), an electro-explosive device 50 according to a first embodiment of the invention comprises a silicon wafer or thermally conductive but electrically insulating substrate 52, such as alumina, with layers of silicon dioxide 53 on the front and back surfaces. The thin layers of silicon dioxide 53 provide electrical insulation from the substrate 52 while providing a low thermal resistance path from one side of the substrate 52 to the other. Preferably, the substrate 52 has a low nominal resistivity and has a width of about 250 mils and the layers 53 of silicon dioxide are about 500 nanometers in thickness.

A thin layer 54 of aluminum is deposited on top of the silicon dioxide layer 53 and is selectively etched away to produce a serpentine pattern. The layer 54 of aluminum forms a first path $\mathbf{54}_1$, a second path $\mathbf{54}_2$, and a bowtie area $\mathbf{54}_3$, with the bowtie area $\mathbf{54}_3$ interconnecting the first and second paths $\mathbf{54}_1$ and $\mathbf{54}_2$. The first and second paths $\mathbf{54}_1$ and $\mathbf{54}_2$ preferably have a width of about 50 mils and the bowtie area $\mathbf{54}_3$ preferably has dimensions of about 5 mils by 10 mils at the thinnest portion of the area $\mathbf{54}_3$.

A layer 58 of zirconium is selectively deposited over the bowtie region $\mathbf{54}_3$. The layer 58 of zirconium is not limited to the shape shown but may cover a greater or lesser area of the bowtie area $\mathbf{54}_3$. For instance, the layer 58 of zirconium may extend across almost the entire length of the bowtie area $\mathbf{54}_3$ from the first path $\mathbf{54}_1$ to the second path $\mathbf{54}_2$. The zirconium layer 58 is preferably about 1 mm (i.e., 1 micron) in thickness.

Layers $\mathbf{55}_1$ and $\mathbf{55}_2$ of titanium/nickel/gold (Ti/Ni/Au) are selectively deposited over the ends of the aluminum paths $\mathbf{54}_1$ and $\mathbf{54}_2$, respectively. The titanium in the layers 55 provides adhesion to the aluminum layer 54, the nickel provides a solderable contact, and the gold protects the nickel surface from oxidation. Contact to the Ti/Ni/Au layers $\mathbf{55}_1$ and $\mathbf{55}_2$ on the aluminum paths $\mathbf{54}_1$ and $\mathbf{54}_2$ may be accomplished in any suitable manner, such as wire bonding, solder reflow, or conductive epoxy. The Ti/Ni/Au layers 55 are preferably about 0.6 $\mu$m in thickness.

Figure 1:
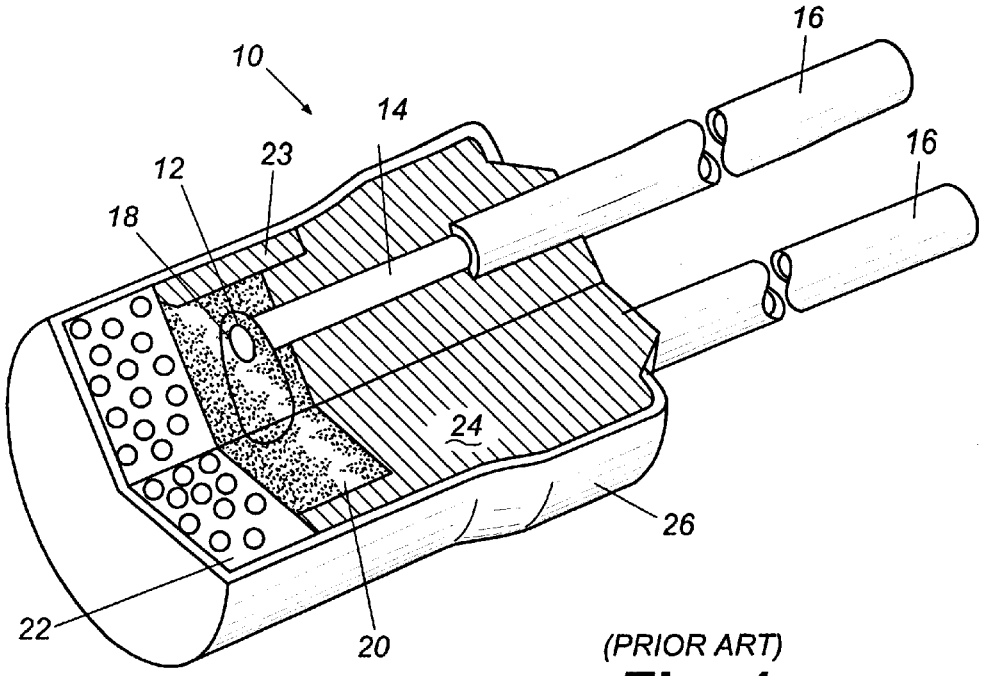
(PRIOR ART) Fig. 1
FIG. 1 is a sectional perspective view of a conventional electro-explosive device.
Figure 2A:
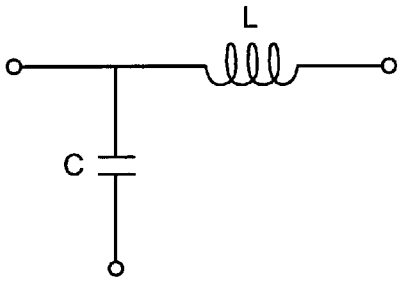
(PRIOR ART) Fig. 2(A)
FIGS. 2(A), (B), and (C) are equivalent circuit schematics for L, Pi, and T passive filters, respectively.
Figure 2B:
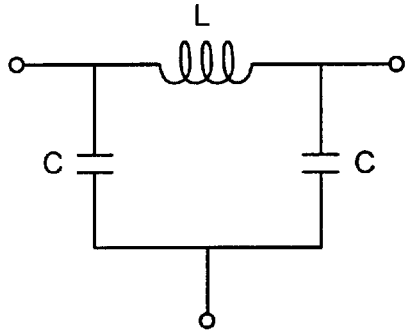
(PRIOR ART) Fig. 2(B)
Figure 2C:
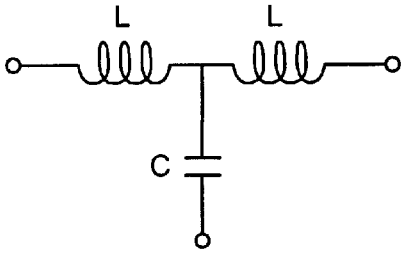
(PRIOR ART) Fig. 2(C)
Figure 3A:
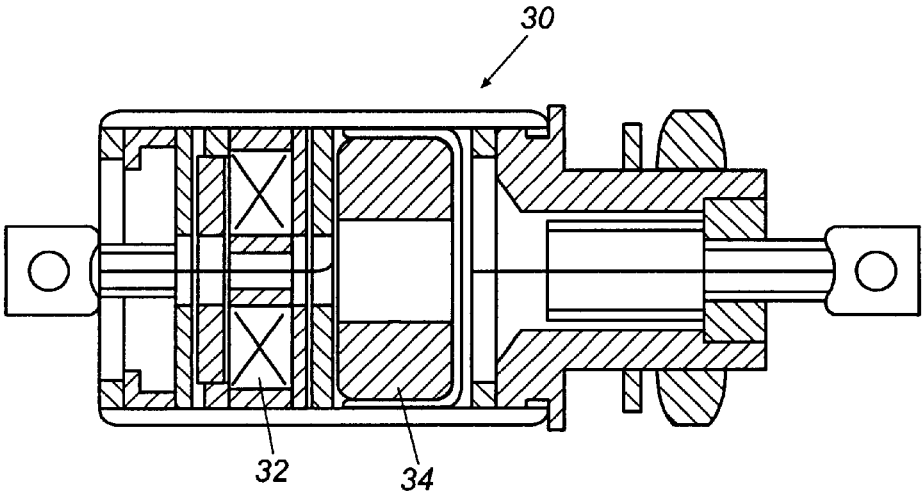
(PRIOR ART) Fig. 3(A)
FIG. 3(A) is a sectional side view of a conventional L-type passive filter.
Figure 3B:
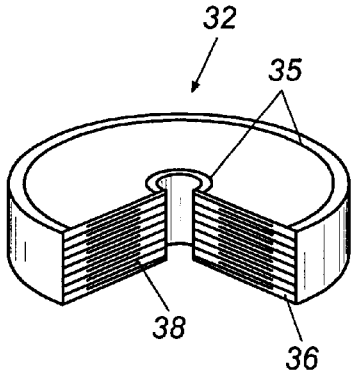
(PRIOR ART) Fig. 3(B)
FIG. 3(B) is a cut-away perspective view of a capacitor shown in the L-type passive filter of FIG. 3(A)
Figure 4:
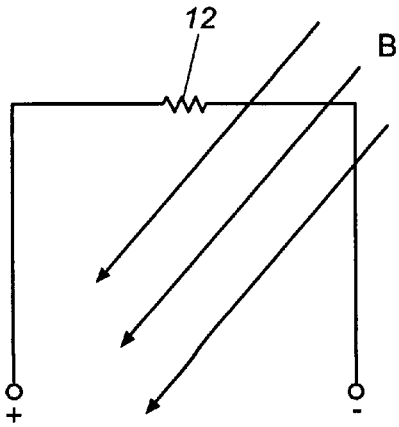
(PRIOR ART) Fig. 4
FIG. 4 is a equivalent circuit of an EED showing magnetic field coupling.
Figure 6:
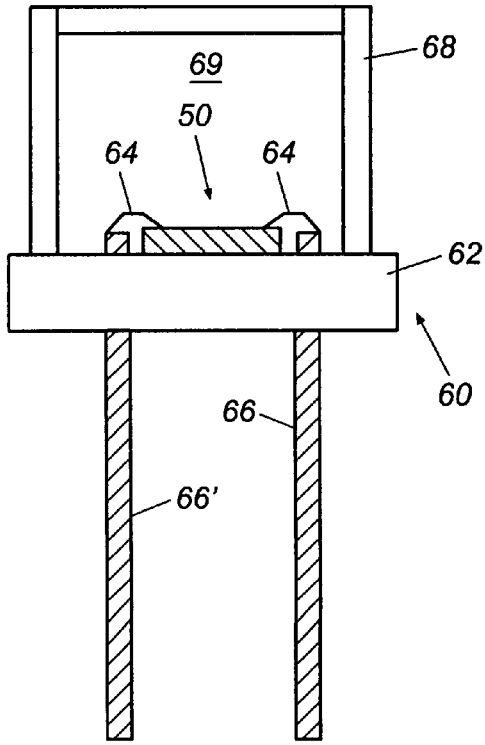
FIG. 6 is a side cross-sectional view of the electro-explosive device of FIG. 5(A) in an initiator.
Figure 5B:
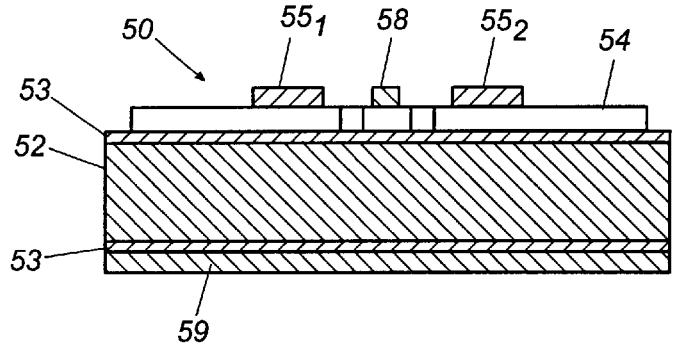
FIG. 5(B) is a side cross-sectional view of the electro-explosive device of FIG. 5(A)

With reference to FIGS. 5(B) and 6, an initiator 60 is formed by depositing a layer 59 of titanium/nickel/gold (Ti/Ni/Au) on the backside of the substrate 52 over the silicon dioxide layer 53 and then attaching the Ti/Ni/Au layer 59 to a header 62, which is preferably formed from a ceramic or a metal alloy, such as Kovar. The Ti/Ni/Au layer 59 is attached to the header 62 with a solder paste or conductive epoxy which is then heated to permit the solder to flow or the epoxy to cure. A conductive epoxy 64 is applied between pins 66 on the header 62 and the Ti/Ni/Au layers 55 and cap 68 is placed on the header 62 to form an enclosure filled with a gas generating mix or pyrotechnic mix 69.

In operation, a firing signal supplied to the initiator 60 is routed through the pins 66, through the conductive epoxy 64, and to the Ti/Ni/Au layers 55. The firing signal produces a current which travels along one of the two paths $\mathbf{54}_1$ or $\mathbf{54}_2$, through the bowtie area $\mathbf{54}_3$ and then through the other of the two paths $\mathbf{54}_1$ or $\mathbf{54}_2$. The resistance of the aluminum layer 54 is essentially comprised of three resistors in series, with the paths $\mathbf{54}_1$ and $\mathbf{54}_2$ each having a resistance of $R_1$ and the bowtie area $\mathbf{54}_3$ having a resistance of $R_b$.

In general, the resistance R of the aluminum layer 54 can be calculated from the following equation:

$$R = \rho\left(\frac{L}{hw}\right), \qquad \text{EQ. 1}$$

where r is the bulk resistivity of the material, L is the length of the metal trace, h is the height or thickness, and w is the width.

With the initiator 60, the electrical impedance presented to a signal applied to the pins 66 is purely resistive in nature and is approximately equal to the sum of $2R_1$ and $R_b$. The aluminum layer 54 defines a resistive divider network with the resistors $R_1$ and $R_b$ and the signal that is actually being applied to the bowtie area $\mathbf{54}_b$ is attenuated by an amount equal to the ration of $R_b/2R_1$. The attenuation A of the applied signal can be simplified as:

$$A = \frac{(L_b / w_b)}{(2L_p / w_p)}, \qquad \text{EQ. 2}$$

where $L_b$ and $w_b$ are the length and width of the bowtie area $\mathbf{54}_3$ and $L_p$ and $w_p$ are the length and width of either path $\mathbf{54}_1$ or $\mathbf{54}_2$.

As is apparent from Equation 2, the attenuation A of a signal is a constant value at low levels of an input signal and is determined only by the relative length to width ratios of the resistors $R_1$ and $R_b$. The aluminum layer 54 is preferably designed to achieve an attenuation A of about 1/20, which is about −26 dB. It will be apparent to those skilled in the art, however, that the amount of attenuation A is not limited to this exact value but that other values of attenuation A can be obtained by simply varying the geometries of the aluminum layer 54.

Due to the attenuation A obtained by the resistive network of resistors $R_1$ and resistor $R_b$, the majority of electrical power supplied to the initiator 60 is converted to heat by ohmically heating the two resistors $R_1$. The resistors $R_1$ possess a large surface to volume ratio so as to provide a large surface area for the conduction of heat from the resistors $R_1$, through the top layer of silicon dioxide 53, into the thermally conductive silicon substrate 52, and to the header 62. The initiator 60 may additionally have a heat sink to further dissipate heat away from the bowtie area $\mathbf{54}_3$ and thus away from the zirconium layer 58.

The EED 50 is therefore insensitive to coupled RF power. Due to the resistive network defined by the resistors $R_1$ and $R_b$, the coupled RF power is attenuated whereby the bowtie $\mathbf{54}_3$ receives only a fraction of the energy. Furthermore, because the heat from the resistors $R_1$ as well as the resistor $R_3$ is routed away from the bowtie area $\mathbf{54}_3$, the bowtie area $\mathbf{54}_3$ and the zirconium layer 58 remain relatively cool. Consequently, coupled RF power can be dissipated into heat without accidentally firing the EED 50.

The EED 50 is also insensitive to an electrostatic discharge (ESD) since the time period of the discharge is too short to heat the bowtie $\mathbf{54}_3$ any appreciable amount. A pulsed signal from an ESD will have the vast majority of the energy coupled to the large resistors $R_1$ with the heat generated by the resistors $R_1$ being safely dissipated through the header 62.

In order to fire the EED 50, a current having a sufficiently long duration is passed through the resistors $R_1$ and $R_b$ to increase the temperatures of the resistor $R_b$. The resistors $R_1$ and $R_b$ have a positive temperature coefficient so that the resistances will increase with the temperature of the aluminum layer 54. Because the bowtie area $\mathbf{54}_3$ is much smaller than the serpentine resistors $R_1$, the firing signal will cause the bowtie area $\mathbf{54}_3$ to heat up much faster than the other areas $\mathbf{54}_1$ and $\mathbf{54}_2$. As the temperature of the bowtie area $\mathbf{54}_3$ increases, the resistance of resistor $R_b$ will increase by upwards of two orders of magnitude and will eventually become larger than the resistors $R_1$. As a result, the bowtie area $\mathbf{54}_3$ will receive most of the electrical power from the firing signal and will rapidly heat and vaporize along with the zirconium layer 58 in a plasma.

The plasma condenses on a small area of nearby pyrotechnic compound 69 causing it to heat. Once a critical volume of the pyrotechnic material 69 reaches its ignition point, the entire pyrotechnic compound 69 ignites. The zirconium layer 58 assists in the ignition of the pyrotechnic compound 69 by increasing the mass of material in the bowtie area $\mathbf{54}_3$ which will change from solid to plasma.

With a larger mass, a greater amount of material is available to condense on the pyrotechnic powder 69 and a greater amount of thermal energy can be transferred.

As described above, when the temperature of the bowtie area $\mathbf{54}_3$ increases, the resistance of resistor $R_b$ will increase. Once the bowtie area $\mathbf{54}_3$ becomes molten, the resistance of resistor $R_b$, which has a geometry selected according to the resistance of an initiation system, matches the parasitic resistance of the initiation system supplying the firing signal. Thus, by matching the increased resistance of the aluminum layer 54 to the initiation system, the maximum amount of power can be transferred to the bowtie area $\mathbf{54}_3$.

The pyrotechnic compound 69 typically is a combination of powdered zirconium and potassium perchlorate. With some previous EED's, a layer of conductive or semiconductor material is heated into a plasma state and the plasma condenses on the pyrotechnic compound in order to ignite the EED.

With the invention, on the other hand, the zirconium layer 58 is converted into the plasma state in conjunction with the bowtie area $\mathbf{54}_3$. The vaporous zirconium aides in the ignition by directly reacting with the potassium perchlorate. The EED according to the invention is consequently a more efficient ignition mechanism since an element of the pyrotechnic mix 69 is ignited by the vaporized metal. By using zirconium which burns when heated to a relatively low temperature and supplied with an oxidizer, an EED of the invention eliminates the need for a primary explosive, such as lead azide. As a result, the EED of the invention can be surrounded by a lower strength and lower cost steel mesh.

An EED according to the invention was subjected to a 12 MHz sinusoidal RF signal which coupled approximately 1.5 W of real power to the EED structure. The EED did not have any additional heat sink and no attempt was made to increase the airflow over the EED structure. After the EED was subjected to this signal for approximately 15 minutes, the heat was effectively dissipated from the EED structure whereby the EED structure could be easily held by hand. Also, a visual inspection of the serpentine resistor and bowtie did not reveal any damage. The EED structure was subjected to additional frequencies with similar results. The EED according to the invention is therefore insensitive to real RF power.

An EED according to the invention was also subjected to an ESD. The ESD consisted of current pulses of approximately 30 amps for a variety of time periods up to 1 msec. A visual inspection of the EED structure after the ESD pulses did not reveal any damage. Due to the geometries of the serpentine resistors and bowtie, the ESD is primarily coupled to the serpentine resistors and away from the bowtie with most of the energy being dissipated by the serpentine resistors. The EED's were also repetitively pulsed with the result that no adverse effects had occurred.

To ensure that the EED's according to the invention would fire with a proper firing signal, EED's were connected to a 480 $\mu$F electrolytic capacitor which had been charged to 8 V. The capacitor was switched in series with the EED structure by a metal-oxide-semiconductor transistor (MOSFET). A variety of EED's were fired with this test setup after RF testing and after ESD testing to verify the functionality of the EED's. As expected, all of the EED's were ignited with a range of 1.0 mJ to 3.0 mJ total energy being absorbed from the electrolytic capacitor.

With the invention, only a small portion of the available 15 mJ of energy is needed to fire the EED. An EED according to the invention can therefore be fired with low energies. The low energy lE firing capability of the invention is especially advantageous when an initiator firing circuit has a high parasitic resistance, such as in an automobile airbag system. The actuation of numerous EED's from a single low energy source is also much more feasible with a low firing energy device. Thus, a single low energy source may be able to activate the numerous airbags which will likely be installed in future designs of automobiles.

An EED according to the invention is a relatively simple integrated structure which can be produced with extremely small geometries. The EED provides a constant attenuation of stray RF and spurious signals across the entire frequency spectrum and can also safely and repetitively dissipate the energy of a typical ESD event in both pin-to-pin and pin-to-case modes.

The invention is not limited to the pyrotechnic compound of zirconium and potassium perchlorate but rather may employ other pyrotechnic compounds. For instance, the pyrotechnic compounds may comprise any suitable combination of a powdered metal with a suitable oxidizer, such as $TiH_{1.68}KClO_4$ or other mixtures such as boron and potassium nitrate $BKNO_3$. If potassium nitrate $KNO_3$ were used as the pyrotechnic compound, a coating of boron could be applied over the bowtie area $\mathbf{54}_3$ to enhance the ignition process. As will be apparent to those skilled in the art, by matching the hot vapor phase of the plasma to the pyrotechnic compound, a variety of materials can be used to coat the bowtie area $\mathbf{54}_3$ to enhance the ignition process.

The material coating the bowtie area $\mathbf{54}_3$ need not be in electrical contact with the bowtie area $\mathbf{54}_3$ but may instead be electrically isolated from the bowtie area $\mathbf{54}_3$. The material is primarily heated by conductive heat transfer from the bowtie area $\mathbf{54}_3$ and is not caused by Joule heating, which occurs when a current flows through the material. Thus, one or more electrically insulating but thermally conductive materials can be placed between the bowtie area $\mathbf{54}_3$ and the coating material.

The invention is also not limited to the serpentine resistors and/or the bowtie area being formed from aluminum but rather may be fabricated from a variety of different conductive materials such as printed conductive traces or conductive epoxy. Further, the dimensions of the serpentine resistors and bowtie area may be varied to obtain different magnitudes of attenuation. Also, an EED according to the invention may have a bowtie area without any type of coating material whereby only the bowtie area would vaporize in a plasma.

Figure 7A:
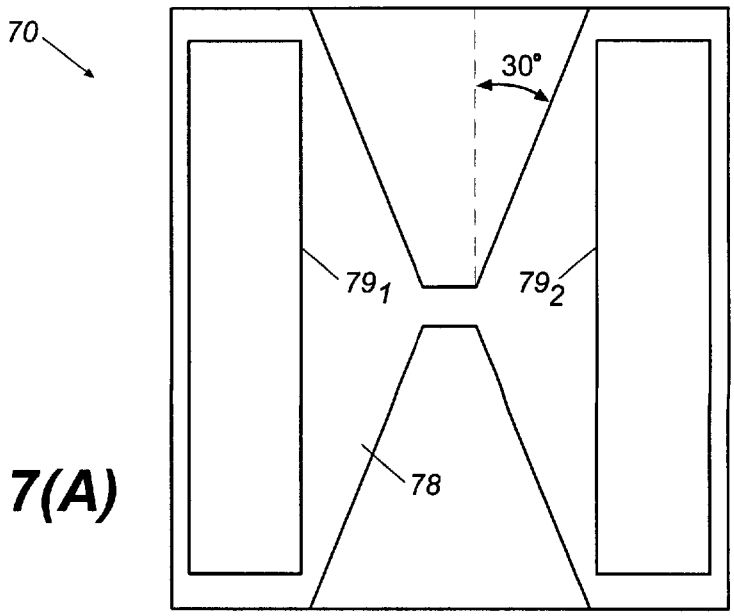
FIG. 7(A) is a top view of an electro-explosive device according to a second embodiment of the invention.
Figure 7B:
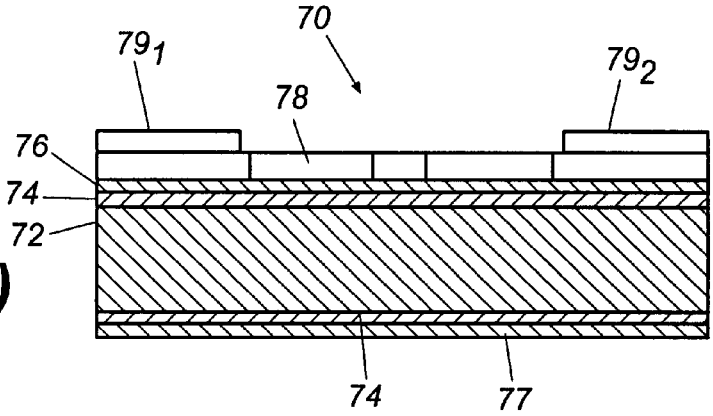
FIG. 7(B) is a side cross-sectional view of the electro-explosive device of FIG. 7(A).

In a second embodiment of the invention, as shown in FIGS. 7(A) and (B), an EED 70 comprises a silicon wafer, or a thermally conductive but electrically insulating substrate 72, such as alumina, which has layers 74 of silicon dioxide grown on the front and back surfaces. The silicon dioxide layers 74 electrically insulate the substrate 72 while providing a low thermal path of resistance across the front and back surfaces of the substrate 72. Preferably, the substrate has a nominal low resistivity and is about 50 mils in width and length and the silicon dioxide layers 74 are approximately 500 nanometers in thickness.

A layer 76 of titanium is vapor deposited onto the front surface followed by a layer 78 of zirconium. The titanium layer 76 is preferably about 0.1 $\mu$m in thickness and the zirconium layer 78 is about 1 $\mu$m in thickness. The zirconium/titanium layer 78 is then selectively etched away to form a bowtie pattern having a central bridge portion with dimensions of about 1.5 mils by 1.5 mils.

A layer 77 of titanium/nickel/gold (Ti/Ni/Au) is deposited over the back layer 74 of silicon dioxide and Ti/Ni/Au layers $\mathbf{79}_1$ and $\mathbf{79}_2$ are also deposited over the ends of the bowtie shaped zirconium layer 78 to form contact pads. As with the embodiment of FIGS. 5(A) and (B), the EED 70 may be attached to the header 62 with a conductive epoxy connecting the header pins 66 to the Ti/Ni/Au contact pads $\mathbf{79}_1$ and $\mathbf{79}_2$, or with other interconnect schemes, including wirebonding, etc.

The resistance of the EED 70 is comprised of three resistors in series, with $R_{land}$ being the resistance through the Ti/Ni/Au layers 79 to either end of the bowtie-shaped zirconium layer 78 and $R_{bow}$ being the resistance of the bowtie-shaped zirconium layer 78. In the preferred embodiment, $R_{land}$ is approximately 10 to 20 ohms while $R_{bow}$ is only about 0.3 ohms. The resistance of the bowtie-shaped zirconium layer 78 is determined in accordance with Equation 1.

The electrical impedance presented to a signal applied across the Ti/Ni/Au contacts 79 is purely resistive in nature and is equal to the sum of $2R_{land}$ and $R_{bow}$. The signals reaching the zirconium layer 78 are attenuated by an amount A equal to $R_{bow}/2R_1$ and, which can be simplified as:

$$A = \frac{(L_{bow} / w_{bow})}{2R_{land}}, \qquad \text{EQ. 3}$$

which is a constant value at low levels of input signal and is determined only by the length $L_{bow}$ and width $w_{bow}$ of the bowtie-shaped zirconium layer 78 and the resistances $R_{land}$.

Although the attenuation A is preferably about 1/20, or −26 dB, any practical value of attenuation A may be achieved by simply varying the geometry of the zirconium layer 78.

With low levels of input signals, the resistances $R_{land}$, which are about 10 to 20 ohms, have a much larger surface to volume ratio than the resistance $R_{bow}$. Thus, at these levels, the resistances $R_{land}$ receive most of the energy from the input signals and convert the energy into heat. The Ti/Ni/Au contacts 79 present a large surface area for the conduction of heat through the top silicon dioxide layer 74, through the thermally conductive substrate 72 and to the header 62. As a result, at low levels of input signal, the zirconium-shaped bowtie 78 dissipates only a fraction of the heat and remains relatively cool. Thus, the EED 70 can remain insensitive to any RF power or ESD which is coupled to the EED 70.

The EED 70 is ignited by supplying a firing signal which has a relatively high intensity. The resistances $R_{land}$ comprise metal-oxide variable resistances which are formed between the titanium layer in contacts 79 and an oxide-phase layer formed on the zirconium layer 78. The metal-oxide variable resistances $R_{land}$ have a relatively high resistance at lower voltages, such as 25 ohms with an applied signal of 1 volt. With higher intensity signals, the metal-oxide resistances $R_{land}$ decrease substantially and become small in comparison to the resistance $R_{bow}$. As a result, with a high intensity firing signal, the resistance $R_{bow}$ will become the largest resistance and will accordingly receive most of the energy from the firing signal until the zirconium layer 78 vaporizes in a plasma. The EED 70 may use the same types of pyrotechnic compound as that of EED 50.

The EED 70 may additionally comprise a shunting element connected in parallel between the Ti/Ni/Au contacts 79. The shunting element has a low impedance at RF frequencies and may comprise a ceramic capacitor, a diode arrangement, or a low impedance fuse. Further, the shunting element can be either a discrete component, a combination of discrete components, or integrated directly on the substrate 72.

An EED according to the second embodiment was found to have an RF impedance of about 12 ohms. A 0.1 μF ceramic capacitor was placed across the EED as the shunting element and the impedance was measured as 12 ohms <0° ohms at 10 kHz and 0.3 ohms <65° at 10 MHz. As expected, the impedance was primarily capacitive at higher frequencies. The inductance of the leads resonated at 4 MHz and appeared inductive at higher frequencies.

To conduct ESD testing, the EED of the second embodiment was subjected to current pulses of approximately 24 A for a variety of time periods up to a fraction of a microsecond. An inspection of the EED after the current pulses revealed that the EED was unaffected. The EED's were repetitively pulsed with no adverse consequences.

To ensure that the EED's of the second embodiment would fire after ESD and RF testing, the EED's were connected to a 40 μF w electrolytic capacitor, which was charged to 22 volts, and was switched in series with the capacitor with a MOSFET transistor. A number of EED's were fired with this arrangement and absorbed from 1 mJ to 3 mJ of total energy. The peak currents measured in the EED were upwards of 16 amps for a duration of about 1 to 2 ms. The EED's 70 can therefore be ignited from only a small fraction of the 10 mJ of available energy. The EED's could also be ignited with a 480 μF capacitor charged to only 10 volts.

With the second embodiment of the invention, non-linear resistances $R_{land}$ are placed in series with the ignition element comprising the bowtie-shaped zirconium layer 78. The invention can therefore protect the ignition element from stray RF signals without the use of a large ferrite sleeve and capacitor. Also, the ignition element can be protected from an ESD without the use of other elements, such as diodes.

Figure 8A:
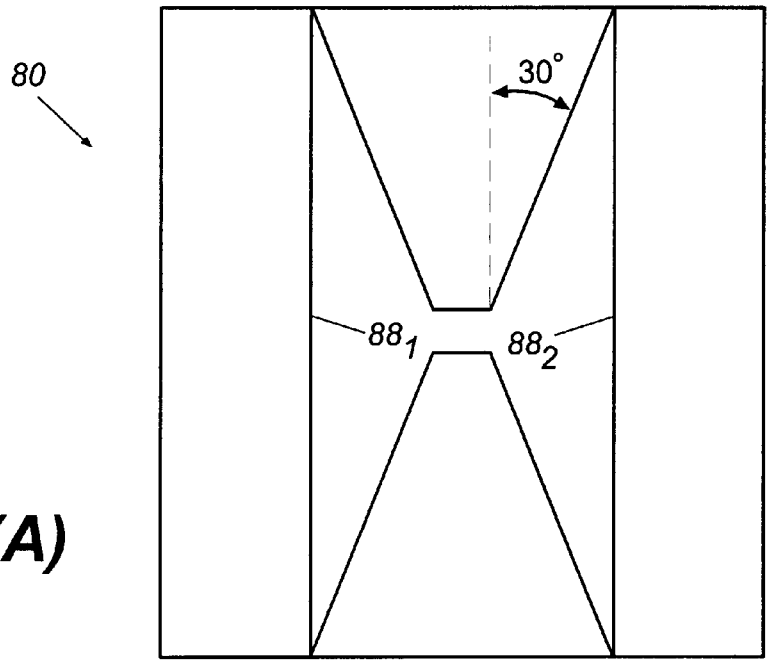
FIG. 8(A) is a top view of a shunting element according to a third embodiment of the invention.
Figure 8B:
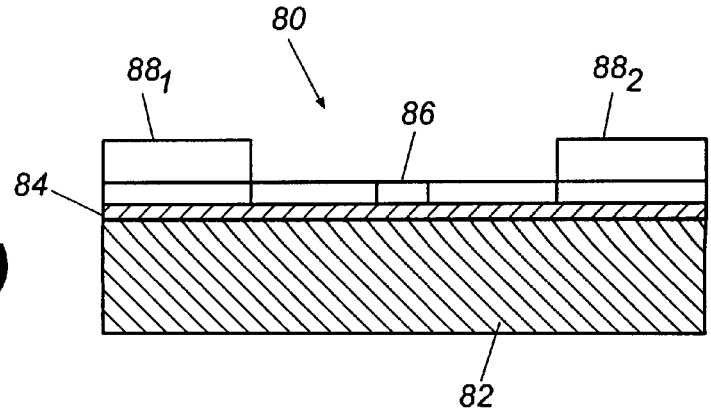
FIG. 8(B) is a side cross-sectional view of the shunting element of FIG. 8(A).

FIGS. 8(A) and (B) illustrate an example of a shunting element 80 which may be placed in parallel across an EED according to the invention, such as EED 50 or EED 70. In this example, the shunting element 80 comprises a low impedance fuse having a polished alumina or silicon substrate 82. A thin layer 84 of titanium is deposited onto the substrate 82 followed by a thicker layer 86 of aluminum which is selectively etched away to form a bowtie pattern. Preferably, the titanium layer 84 is about 0.1 μm in thickness and the aluminum layer is about 1.0 μm in thickness and has dimensions of about 1 mil by 1 mil at the bridge area of the bowtie pattern. Also, the substrate has a width of about 60 mils. Two layers of titanium/nickel/gold (Ti/Ni/Au) $\mathbf{88}_1$ and $\mathbf{88}_2$ are deposited onto either end of the bowtie-shaped aluminum layer 86 in order to form contacts for the shunting element 80.

The contacts $\mathbf{88}_1$ and $\mathbf{88}_2$ are connected in parallel to the contacts on the EED, such as contacts $\mathbf{55}_1$ and $\mathbf{55}_2$ or contacts $\mathbf{79}_1$ and $\mathbf{79}_2$. The resistance of the shunting element 80 is approximately 0.2 ohms and therefore provides a low impedance resistive path for shunting the current away from the EED, thereby protecting the igniter. The shunting element 80 also preferably provides a low thermal impedance path from the aluminum layer 86 to the substrate 82 as well as to a heat sink which may be in thermal contact with the substrate 82.

With low levels of coupled RF energy and with an ESD, the energy is routed through the shunting element 80 due to its low impedance. When a firing signal is received, on the other hand, the firing signal has a duration and energy level which are sufficient to open-circuit the shunting element 80. Once the shunting element 80 has been removed from the circuit, the firing signal is coupled to the EED for igniting the EED. As will be apparent to those skilled in the art, the amount of energy needed to open-circuit the shunting element 80 can be adjusted by varying the geometry of the aluminum layer 86.

A shunting element according to the invention is not limited to the shunting element 80. For instance, a shunting element may be integrated on the same substrate as the EED or may be fabricated as a discrete component. Further, a diode may additionally or alternatively be used as the shunting element. A diode may be integrated directly onto the silicon substrate of the EED. For instance, a pn junction or a Schottky barrier both possess a high enough junction capacitance per unit area to effectively shunt stray RF signal. Furthermore, a shunting element according to the invention may be used in applications other than with an EED according to the invention, such as with other EED's or in entirely different types of circuits.

Figure 9:
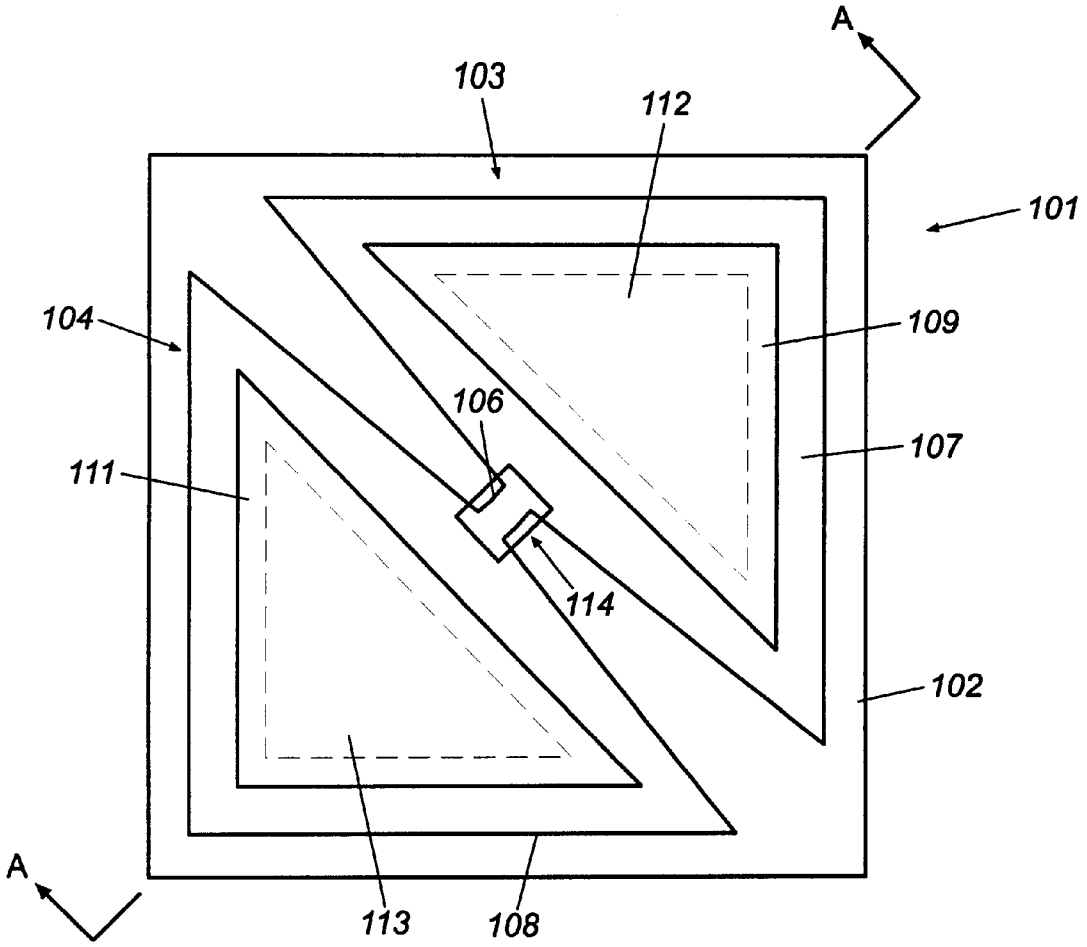
FIG. 9 is a top plan view of an electro-explosive device that embodies principles of the invention in an alternate form, including integrated shunt diodes and a chemically explosive bridge overcoating.
Figure 10:
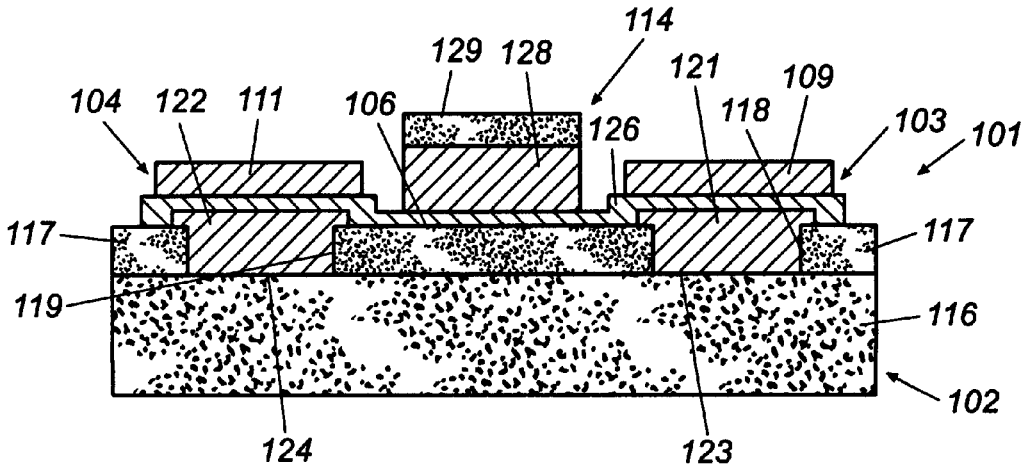
FIG. 10 is a cross-sectional view of the electro-explosive device taken along A—A of FIG. 9.

FIGS. 9 through 12 present an alternate embodiment of the present invention having integrally formed shunting diodes for protection against ESD events and an enhanced bridge overcoating for increased firing efficiency. Referring first to FIG. 10, the EED 101 is seen to be formed on a silicon wafer substrate 102 that, in the preferred embodiment, is generally square but could be any convenient shape. A first generally triangular land 103 is deposited on one side of the substrate 102 and a second generally triangular land 104 is deposited on the opposite side of the substrate 102. The lands 103 and 104 are generally spaced apart and electrically isolated from each other except for a relatively narrow conductive bridge 106 that couples and electrically connects the lands together. The land 103 preferably is formed partially of a deposited layer of palladium 107 and the land 104 preferably is formed partially of a deposited layer 108 of palladium. In the preferred embodiment, the bridge 106 is also formed of palladium and, in fact, the lands 103 and 104 and the bridge 106 preferably are deposited as a single layer of palladium using common integrated circuit etching and deposition techniques.

A first diode 112 is formed beneath and is electrically coupled to the palladium layer 107 of the first land 103 and, similarly, a second diode 113 is formed beneath and electrically coupled to the palladium layer of the second land 104. The formation and structure of these diodes is described in more detail below. A first contact pad, which preferably is formed of composite layers of titanium, nickel, and gold (Ti/Ni/Au) is deposited on the palladium layer 107 of the first land 103 and a second similar contact pad 111 is deposited on the palladium layer 108 of the second land 104. The contact pads provide a suitable surface to which electrical leads can be connected to the lands by means of solder, conductive epoxy, or the like for supplying firing current to the device. A chemically explosive composite overcoating 114, described in more detail below, is provided on the bridge 106 for enhancing the energy and increasing the dispersion of a firing event.

Referring now to FIG. 10, which is a cross section taken along A—A of FIG. 9, the substrate 102 is seen to comprise a silicon chip 116 grown and processed in the traditional manner as known by those of skill in the art. A layer 117 of silicon dioxide is formed on the surface of the chip and functions as an electrical insulator. Two spaced apart triangular shaped openings 118 and 119 are etched in the silicon dioxide layer using any appropriate etching technique to expose the surface of the silicon chip. A first layer or pad 121 of aluminum is then deposited over the first etched opening 118 and a second layer or pad 122 of aluminum is deposited over the second etched opening 119. The aluminum pads can be deposited on the chip using any appropriate technique such as, for example, vapor deposition or photo masking. It will be clear to those of skill in the art that, with this configuration, the first aluminum pad 121 forms a first Schottky barrier junction 123 with the surface of the silicon chip 116 and the second aluminum pad 122 forms a second Schottky barrier junction 124 with the surface of the silicon chip 116. Accordingly, the aluminum pads and silicon chip form a pair of spaced apart Schottky diodes 112 and 113 (FIG. 9) that are integrally formed with the EED 101.

The EED 101 further comprises a bow-tie shaped layer 126 of palladium deposited over the surface of the chip. The layer 126 of palladium is shaped and configured to define a first relatively large area 107, a second relatively large area 108, and a relatively small bridge 106 that extends between and electrically couples the larger areas of the bow-tie together. The first area 107 of the bow-tie covers and is electrically bonded to the first Schottky diode 112 and the second area 108 of the bow-tie covers and is electrically bonded to the second Schottky diode 113.

The first contact pad 109 is deposited on the surface of the first area 107 of the bow-tie shaped palladium layer and the second contact pad 111 is deposited on the surface of the second area 108 of the bow-tie shaped palladium layer. The contact pads 109 and 111 preferably comprise composite layers of Ti/Ni/Au in order to provide contacts to which electrical leads for supplying firing current can be bonded to the relatively large areas 107 and 108 of the bow-tie shaped palladium layer 126.

The deposition, etching, and shaping of the various layers of material and metal on the surface of the chip 116 is accomplished with traditional integrated circuit fabrication techniques, which have been described in detail above relative to other embodiments of this invention. Such techniques are generally known to those of skill in the art. It should be understood, however, that the preferred choices of metals for the various layers, the shape of the layers, and the relative sizes of the various portions of the layers could be different than those of the preferred embodiment according to particular needs. For example, gold or aluminum might be substituted for the palladium of the bow-tie and other combinations of appropriate metals could be substituted for the Ti/Ni/Au of the contact pads. Such substitutes are considered to be equivalent to the preferred choices described above.

A composite overcoat 114 is deposited atop the bridge 106. As illustrated in FIG. 10, the composite overcoat in the preferred embodiment comprises a a fuel such as zirconium deposited on the bridge and a layer 129 of an oxidizer such as, for example, copper oxide or iron oxide, also known as thermite, deposited atop the zirconium layer 128. Copper oxide and iron oxide are advantageous because they are formed of molecules with relatively weak chemical bonds and thus tend to donate their oxygen readily in a chemical reaction contributing to high temperature exothermic reactions. The composite overcoat 114 can be deposited on the bridge 106 using any of a variety of deposition techniques as described in more detail above. Furthermore, the composite overcoat need not necessarily be deposited in layers at all but could be deposited as a single layer of a mixture of the fuel and oxidizer. In addition, the choice of zirconium in the preferred embodiment is not a limitation of the invention nor is the choice of oxidizer. Any appropriate chemically explosive overcoating might be substituted within the scope of the present invention.

Figure 11A:
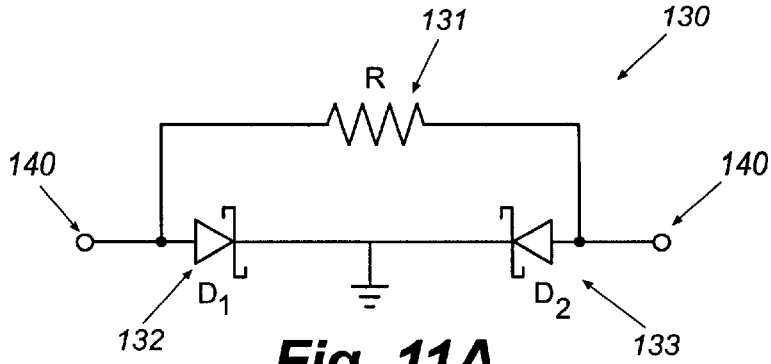
FIG. 11A is an equivalent circuit for the electro-explosive device of FIG. 10.
Figure 11B:
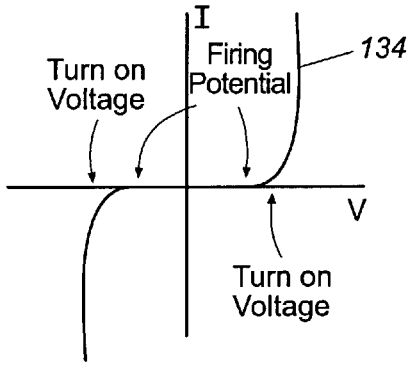
FIG. 11B is a typical voltage/current graph for the equivalent circuit of FIG. 11A.

FIGS. 11A and 11B show an equivalent circuit and a voltage/current graph respectively for the EED of FIGS. 9 and 10. Referring to FIG. 11A, the equivalent circuit is seen to comprise a resistance R indicated by reference numeral 131, which represents the sum of the resistances of the lands and the bridge of the EED. Diode D1 (132) and diode D2 (133) represent the two integrally formed Schottky diodes 112 and 113 of the EED. Contacts 140 of the equivalent circuit represent the contact pads 107 and 108 of the EED.

In practice, the resistance of the bridge, which represents most of the resistance R, is selected so that the bridge will conduct sufficient current to vaporize through ohmic heating when a firing potential of just less than the turn-on voltage of the diodes 132 and 133 is applied to the contacts 140. This turn-on voltage can be predetermined with Schottky diodes by controlling the size of the junction between the aluminum and the surface of the silicon chip substrate as well as controlling the doping and other parameters of the materials themselves.

In operation, the EED of this embodiment functions as follows. The contact pads 109 and 111 are each electrically connected to a respective pair of leads by means, for example, of wirebond, conductive epoxy, or solder. The leads are then coupled to a switchable source of firing potential. When in its dormant state prior to an intentional firing, the EED is protected from accidental firing resulting from ESD events by the diode shunt formed by the two diodes D1 and D2. More specifically, electric potential induced across the contacts 140 by an ESD event typically is much higher than the turn-on voltage of the diodes formed on the EED. Thus, the diodes appear to ESD induced potentials as closed circuit shunts and electric current induced by the potential is conducted away from the resistive bridge to prevent ohmic heating of the bridge and consequent accidental firing.

When it is desired to fire the ESD, a firing potential that is just less than the turn-on voltage of the diodes is applied to the contacts from a source capable of delivering sufficient firing current for an appropriate length of time. The firing potential can be provided, for example, by switching a charged capacitor in series with the EED or by any other appropriate means. Since the firing potential is less than the turn-on voltage of the diodes, the diodes do not turn-on and the full firing potential is applied across the resistive bridge. As a result, current flows through the bridge causing it to heat rapidly and to vaporize in a relatively high energy plasma explosion.

The heat generated in the palladium bridge by the firing current is directly coupled by means of conduction to the composite overcoat 114 of the EED. As a consequence, the overcoat is also heated rapidly until the zirconium layer of the overcoat also begins to vaporize in a plasma. This, in turn, initiates a chemically explosive reaction between the zirconium of the overcoat and the oxidizer layer. The result is a chemical/plasma explosion in the vicinity of the bridge 106 that is substantially more energetic then the plasma generated by of the bridge alone and that generates a fireball that projects outwardly from the surface of the EED a distance substantially greater. Thus, the composite overcoat 114 greatly enhances the efficiency of the EED in igniting a pyrotechnic mix packed against its surface while the integral diode shunt protects the bridge from ESD events.

The advantages of this embodiment of the invention are many. For example, since the diode shunt arrangement is formed integrally with the EED chip itself using traditional microelectronic etching and deposition techniques, the EED is substantially less costly to manufacture than devices that use discrete components and can be manufactured in large numbers by automated processes. Perhaps more advantageous, however, is the substantially enhanced firing efficiency of the EED of this embodiment as a result of the composite overcoat of metal and oxidizer on the bridge element. This enhanced firing efficiency has been found to eliminate the need to pack pyrotechnic compound such as ZPP against the surface of the EED using expensive high pressure loading techniques to insure coupling between the explosive pyrotechnic compound and the bridge. In fact, with the present embodiment, the pyrotechnic compound can be loaded against the EED using relatively inexpensive loading techniques. Further, since high pressure loading is no longer required, relatively expensive metal casings or other confinement mechanisms for the EED and its pyrotechnic compound are not necessary and much less expensive plastic casings and/or other confinement mechanisms can easily be used. Finally, the firing efficiency of the EED of this embodiment is virtually unaffected by thermal or mechanical migration of the pyrotechnic mix away from the surface of the EED since the high energy relatively large fireball generated upon firing efficiently engages the pyrotechnic even when it is not in direct contact with the EED.

Figure 12A:
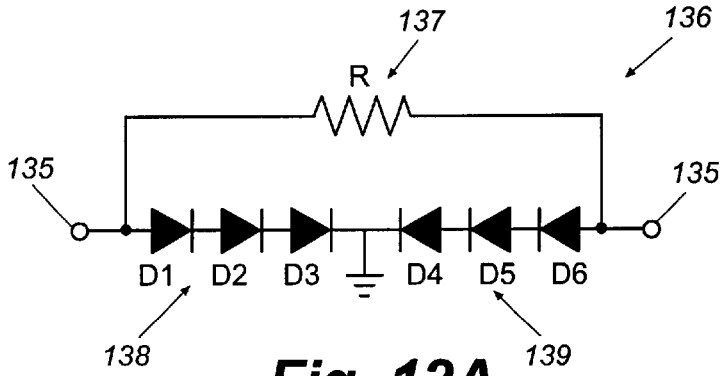
FIG. 12A is an alternate equivalent circuit for enhancing the predictability of the turn-on voltage of an electro-explosive device.
Figure 12B:
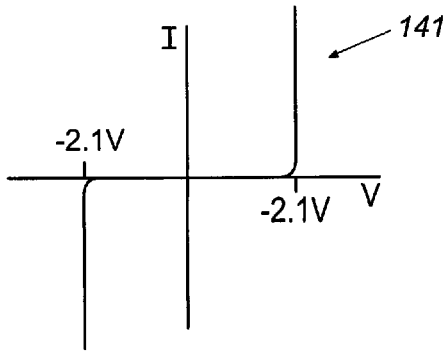
FIG. 12B is a typical voltage/current graph for the equivalent circuit of FIG. 12A.

FIGS. 12A and 12B present an equivalent circuit and a typical voltage/current (V/I) graph of an alternate form of the EED of FIGS. 9 and 10. One disadvantage of using single Schottky diodes as described above is their slightly unpredictable turn-on voltage and their relatively gradual turn-on characteristics. In the embodiment of FIGS. 12A and 12B, a series of three standard PN junction diodes are formed on the silicon chip in place of each of the Schottky diodes. The advantage of such an arrangement stems from the fact that the turn-on or breakdown voltage of a PN junction diode is very predictable at about 0.7 volts and the transition from its nonconducting to its conducting state is sharp and well defined. Thus, three series connected PN junction diodes provides a repeatable and predictable turn-on voltage of 2.1 volts with a transition that is very sharp as shown in FIG. 12B. With such an arrangement, EED devices can be manufactured in large quantities with repeatable and predictable firing voltages of, for example, 2.0 volts while ESD events greater than 2.1 volts are safely shunted. Clearly, any number of diodes could be fabricated on the chip to achieve a wide range of firing voltage thresholds.

The foregoing description of the preferred embodiments of the invention has been presented for purposes of illustrating the features and principles thereof. It is not intended to be exhaustive or to limit the invention to the precise forms disclosed. Many modifications and variations are possible in light of the above teaching.

The embodiments were chosen and described in order to explain the principles of the invention and their practical application; various other possible embodiments with various modifications as are suited to the particular use are also contemplated and fall within the scope of the present invention.

What is claimed is:

1. An electro-explosive device fabricated on the surface of a substrate, said electro-explosive device comprising:

a layer of conducting material deposited on said surface of said substrate, said layer of conducting material being configured to define a bridge on said substrate for vaporizing in a plasma in response to the flow of electric current through said bridge;

a composite overcoat formed on said bridge and bonded with said layer of conducting material of said bridge, said composite overcoat comprising a metal and an oxidizer, wherein said metal and said oxidizer are deposited to form separate layers of metal and oxidizer bonded with said layer of conducting material of said bridge; and means for coupling said bridge to a source of firing potential for inducing current flow through the bridge to cause an explosion of said composite overcoat for igniting a pyrotechnic mix disposed adjacent said electro-explosive device.

2. An electro-explosive device as claimed in claim 1 and wherein said metal layer is deposited on said bridge and said oxidizer layer is deposited on said metal layer.

3. An electro-explosive device as claimed in claim 2 and wherein said metal comprises zirconium.

4. An electro-explosive device as claimed in claim 3 and wherein said oxidizer comprises iron oxide.

5. An electro-explosive device as claimed in claim 3 and wherein said oxidizer comprises copper oxide.

6. An electro-explosive device as claimed in claim 1 and wherein said means for coupling said bridge to a source of firing potential comprises a first conducting land formed on said surface of said substrate over said layer of conducting material and a second conducting land formed on said surface of said substrate over said layer of conducting material and being spaced from said first conducting land, said bridge interconnecting said first and second lands and said lands being connectable to leads for supplying a firing potential to said bridge.

7. An electro-explosive device as claimed in claim 6 and further comprising a diode shunt formed on said surface of said substrate electrically connected in parallel with said bridge, said diode shunt directing current resulting from ESD induced potentials away from said bridge to prevent accidental firing of the EED by ESD events.

8. An electro-explosive device as claimed in claim 7 and wherein said substrate comprises a silicon chip and wherein said diode shunt comprises first diode means integrally formed on said silicon chip connecting said first land to a current sink and a second diode means integrally formed on said silicon chip connecting said second land to a current sink.

9. An electro-explosive device as claimed in claim 8 and wherein said first and second diode means comprise PN junction diodes formed on said silicon chip.

10. An electro-explosive device as claimed in claim 9 and wherein said first and second diode means each comprises a series of PN junction diodes formed on said silicon chip and electrically connected in series with each other.

11. An electro-explosive device as claimed in claim 8 and wherein said first and second diode means comprise Schottky diodes.

12. An electro-explosive device with enhanced insensitivity to radio frequency and electrostatic discharge for igniting a pyrotechnic mix, said electro-explosive device comprising a silicon substrate having a surface, a layer of insulating material formed on said surface of said silicon substrate, a conductive bridge formed on said conductive layer, said conductive bridge vaporizing in a plasma in response to a predetermined current flow through said conductive bridge, and a chemically explosive overcoat comprising a metal and an oxidizer deposited on said conductive bridge so as to be bonded with said conductive layer of said conductive bridge for generating an explosive fireball upon vaporization of said conductive bridge to ignite a pyrotechnic mix disposed adjacent said electro-explosive device, wherein said metal and said oxidizer are deposited on said conductive bridge in separate layers of metal and oxidizer that are bonded with said conductive layer of said conductive bridge.

13. An electro-explosive device as claimed in claim 12 and wherein said metal layer is deposited on said conductive bridge and said oxidizer layer is deposited on said metal layer.

14. An electro-explosive device as claimed in claim 13 and wherein said metal comprises zirconium.

15. An electro-explosive device as claimed in claim 14 and wherein said oxidizer comprises iron oxide.

16. An electro-explosive device as claimed in claim 14 and wherein said oxidizer comprises copper oxide.

17. An electro-explosive device as claimed in claim 12 and further comprising a diode shunt integrally formed on said silicon substrate and being electrically connected in parallel with said conductive bridge for conducting spurious current away from said conductive bridge for preventing accidental firing of the electro-explosive device by such spurious current.

18. An electro-explosive device as claimed in claim 17 and further comprising a first conductive land formed on said layer of insulating material over said conductive layer, a second conductive land formed on said layer of insulating material over said conductive layer, spaced from said first conductive land, said conductive bridge interconnecting said first and second conductive lands, and means for connecting said first and second lands to a source of firing potential for inducing current flow through said conductive bridge.

19. An electro-explosive device as claimed in claim 18 and wherein said diode shunt comprises a first diode means formed on said silicon substrate and connected between said first conductive land and said silicon substrate and a second diode means formed on said silicon substrate and connected between said second conductive land and said silicon substrate.

20. An electro-explosive device as claimed in claim 18 and wherein said first diode means comprises at least two diodes connected in series between said first land and said silicon substrate and said second diode means comprises at least two diodes connected in series between said second land and said silicon substrate.

* * * * *

UNITED STATES PATENT AND TRADEMARK OFFICE

CERTIFICATE OF CORRECTION

PATENT NO. : 6,192,802 B1
DATED : February 27, 2001
INVENTOR(S) : Thomas A. Baginski; Todd S. Parker It is certified that error appears in the above-identified patent and that said Letters Patent is hereby corrected as shown below:

Title page,
Item [75], Inventors, should read -- Thomas A. Baginski, Auburn, AL (US); Todd S. Parker, Hollister, CA (US)

Item [56], References Cited, insert:
-- U.S. PATENT DOCUMENTS,

| | | | |
|---|---|---|---|
| 2,821,139 | 1/28/58 | Apstein, et al. | 102/70.2 |
| 3,211,096 | 10/12/65 | Forney, et al. | 102/28 |
| 3,420,174 | 1/7/69 | Potter | 102/28 |
| 3,572,247 | 3/23/71 | Warshall | 102/28 |
| 3,640,224 | 2/8/72 | Petrick, et al. | 102/28 |
| 3,669,022 | 6/13/72 | Dahn, et al. | 102/28 |
| 3,682,096 | 8/8/72 | Ludke, et al | 102/28 |
| 3,735,705 | 5/29/73 | Hudson, Jr., et al. | 102/28 |
| 3,753,403 | 8/21/72 | Menichelli | 102/28 -- |

Item [56], References Cited, insert:
-- FOREIGN PATENT DOCUMENTS

| | | |
|---|---|---|
| 0567959A2 | 11/3/93 | (EPO) |
| 3918408A1 | 12/13/90 | (Germany) -- |

UNITED STATES PATENT AND TRADEMARK OFFICE

CERTIFICATE OF CORRECTION

PATENT NO. : 6,192,802 B1 
DATED : February 27, 2001
INVENTOR(S) : Thomas A. Baginski; Todd S. Parker It is certified that error appears in the above-identified patent and that said Letters Patent is hereby corrected as shown below:

Item [56], References Cited, insert:
-- OTHER PUBLICATIONS

"The Semiconductor Junction Igniter: A Novel RF and EDS Insensitive Electro-Explosive Device, Thomas A. Baginski, A Scottedward Hodel, IEEE Transactions on Industry Application, Vol. 29, No. 2 March/April 1993 Electrical Ignition Element, Uwe Brede, August 19, 1987"--

Signed and Sealed this

Twenty-fifth Day of December, 2001

*Attest:*

*Attesting Officer*

JAMES E. ROGAN
*Director of the United States Patent and Trademark Office*